US007959009B2

(12) United States Patent
Weaver et al.

(10) Patent No.: US 7,959,009 B2
(45) Date of Patent: Jun. 14, 2011

(54) SYSTEM AND APPARATUS FOR PROTECTING A SUPPORT FRAME USED IN A SCREENING ARRANGEMENT

(75) Inventors: Mark V. Weaver, Columbus, NC (US); Peter Helmut Franz Freissle, Spartanburg, SC (US)

(73) Assignee: Polydeck Screen Corporation, Spartanburg, SC (US)

( * ) Notice: Subject to any disclaimer, the term of this patent is extended or adjusted under 35 U.S.C. 154(b) by 0 days.

(21) Appl. No.: 12/342,740

(22) Filed: Dec. 23, 2008

(65) Prior Publication Data

US 2010/0155308 A1 Jun. 24, 2010

(51) Int. Cl.
*B07B 1/46* (2006.01)

(52) U.S. Cl. ..... 209/413; 209/405; 209/412

(58) Field of Classification Search ..... 209/405, 209/408, 409, 412, 413
See application file for complete search history.

(56) References Cited

U.S. PATENT DOCUMENTS

| | | | | | |
|---|---|---|---|---|---|
| 5,361,911 | A | * | 11/1994 | Waites et al. | 209/399 |
| 5,363,970 | A | * | 11/1994 | Freissle | 209/399 |
| 5,385,242 | A | | 1/1995 | Freissle | |
| 5,464,101 | A | | 11/1995 | Freissle | |
| 5,938,042 | A | | 8/1999 | Freissle et al. | |
| 6,357,597 | B1 | * | 3/2002 | Theeler, Sr. | 209/395 |
| 6,957,741 | B2 | | 10/2005 | Freissle et al. | |
| 7,063,214 | B2 | * | 6/2006 | Schulte et al. | 209/405 |
| 7,066,334 | B2 | * | 6/2006 | Eeles et al. | 209/405 |
| 7,240,801 | B2 | | 7/2007 | Freissle et al. | |
| 7,296,685 | B2 | * | 11/2007 | Malmberg | 209/405 |
| 7,413,087 | B2 | | 8/2008 | Kriel | |
| 2008/0257791 | A1 | * | 10/2008 | Malmberg | 209/405 |
| 2009/0184032 | A1 | * | 7/2009 | Zubovich | 209/405 |
| 2009/0301944 | A1 | * | 12/2009 | Kriel | 209/405 |

OTHER PUBLICATIONS

Multotec Manufacturing brochure, "Saddle Top and T-Bar Rail Systems".

* cited by examiner

*Primary Examiner* — Joseph C Rodriguez
(74) *Attorney, Agent, or Firm* — Dority & Manning, PA

(57) ABSTRACT

A screening arrangement and a modular system and modular protective cover for protecting a support frame in a screening arrangement is disclosed. The modular system includes a plurality of modular protective covers mounted in side-by-side relationship. Each of the modular protective covers includes a top surface and two opposing side walls that define a recess. The modular protective cover has a male component located at a first end of the modular protective cover and a female component located at a second end of the modular protective cover. The male component of the modular protective cover is adapted to mate with the female component of an adjacent modular protective cover to provide a generally continuous protective surface along a length of a support frame.

11 Claims, 6 Drawing Sheets

SYSTEM AND APPARATUS FOR PROTECTING A SUPPORT FRAME USED IN A SCREENING ARRANGEMENT

BACKGROUND

Screening arrangements are used in the mining and similar industries to size and separate materials. Certain screening arrangements include modular screening systems which are composed of a plurality of modular and replaceable screening media. These modular screening systems often include steel or other support structures to support modular screening media.

Existing steel or other structures used to support modular screening media often fail due to abrasive contact with screened material or by exposure to chemicals in the screened material. Current solutions for providing longer service life of these structures include modular protective covers, more exotic materials (e.g. using stainless steel instead of carbon steel in structure's fabrication), bonded rubber lining, spray-on coatings, additional thickness of the structure, or added layers of wear (sacrificial) materials.

Each of these remedies has inherent inadequacies. Current modular covers, such as molded plastic or rubber shapes that surround the top and sometimes sides of the protected structure fail to provide a seal at their interface locations. This allows both abrasive and chemical attacks of the protected structure. More expensive materials, such as stainless steel or composite materials, often last longer but are prohibitive in terms of cost. Moreover, these materials may offer improved resistance to chemical attack but typically do not outperform more conventional structural materials for abrasion resistance. Rubber lining and applied coatings eventually wear and are difficult to replace on site. Similarly, sacrificial materials, such as steel plating, are also difficult to replace on site.

Thus a need exists for a system and an apparatus for protecting support structures that overcomes these deficiencies.

SUMMARY

One exemplary embodiment of the present invention provides a modular system for protecting a support frame used in a screening arrangement. The modular system includes a plurality of modular protective covers mounted in side-by-side relationship. Each of the modular protective covers has a top surface and two opposing side walls that define a recess. A male component is located at a first end of the modular protective cover and a female component is located at a second end of the modular protective cover. The male component of each modular protective cover is adapted to mate with the female component of an adjacent modular protective cover.

Another exemplary embodiment of the present invention provides a screening arrangement for use in screening materials. The screening arrangement includes a support frame and a plurality of protective covers mounted in side-by-side relationship along a length of a support frame. Each of the modular protective members has a top surface and two opposing side walls defining a recess configured to slide over the support frame. The modular protective covers have a male component located at a first end of the modular protective cover and a female component located at a second end of the modular protective cover. The male component of each modular protective cover is adapted to mate with the female component of an adjacent modular protective cover to provide a generally continuous surface along a length of the support frame.

A further exemplary embodiment of the present invention provides a protective cover for protecting a support frame used in a screening arrangement. The protective cover includes a top surface and two opposing side walls defining a recess. The protective cover includes a male component located at a first end of the modular protective cover and a female component located at a second end of the modular protective cover.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
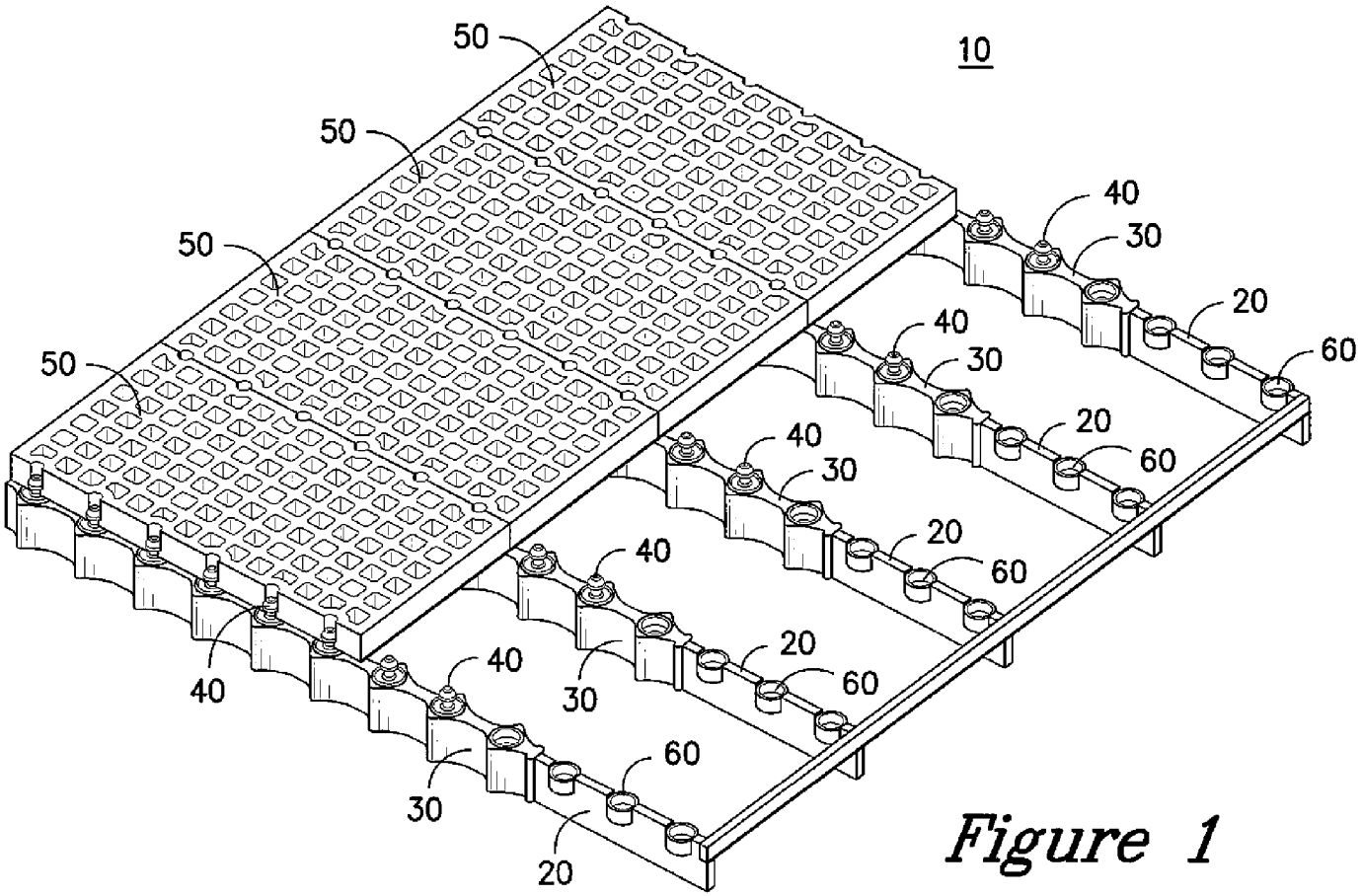
FIG. 1 provides a perspective view of a screening arrangement according to one embodiment of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Referring now to FIG. 1, an exemplary embodiment of a screening arrangement is disclosed. The screening arrangement 10 includes a plurality of support frames 20 mounted in parallel relationship to one another. Support frames 20 support screening media 50 which are used to separate and size material. The support frames 20 may be composed of steel or other material capable of supporting the screening media 50.

The screening media 50 shown in FIG. 1 are modular screen panels with square apertures. Screening media is available in a variety of different types of materials and may include apertures having a variety of different types and sizes. For example, certain screening media may be formed from a plastic material such as polyurethane. Other screening media may be composed of steel. Screening media may include square apertures, zig-zag apertures, ribbed apertures, elongated apertures or other apertures of varying width and length. The type of screening media used in a particular screening arrangement depends on the type of materials being screened and various other factors.

A securing device 40 is used to fasten screening media 50 to the support frame 20. The securing device 40 shown in FIG. 1 comprises a protrusion adapted to engage an indentation formed in the screening media. An example of such a securing device 40 is disclosed in U.S. Pat. No. 6,957,741 which is incorporated herein by reference. However, the present disclosure is not limited to this exemplary securing device. For example, the securing device may also include a sleeve adapted to receive a protrusion formed in the screening media. An example of such a securing device is disclosed in U.S. Pat. No. 5,464,101 which is incorporated herein by reference. A variety of securing devices for securing screening media to a support frame are known. Using the teachings disclosed herein, one of ordinary skill in the art will recognize that any such securing devices may be used without deviating from the scope and spirit of the present invention. For example, the securing device may include rails, pins, snaps, or other securing device.

The support frame 20 includes a plurality of openings or sockets 60 for receiving the securing devices 40. The sockets 60 may be spaced at regular intervals or irregular intervals along the length of the support frame. A securing device 40 may be secured within a socket 60 in a variety of ways. For example, a securing device 40 may be secured to the support frame 20 by a screw thread. In other embodiments, the securing device 40 may be snapped into the support frame 20.

During a screening process, the support frames 20 will be exposed to abrasive contact with screened material and also to chemicals in the screened material. Such exposure may lead to failure of the support frames resulting in costly repairs and time delays. To address this concern, the exemplary embodiment of the present invention depicted in FIG. 1 provides a screening arrangement 10 that includes a support frame 20 and a plurality of protective covers 30 mounted in side-by-side relationship along the length of the support frame 20. The protective covers 30 are configured to provide a generally continuous protective surface along the length of a support frame 20.

Figure 4:
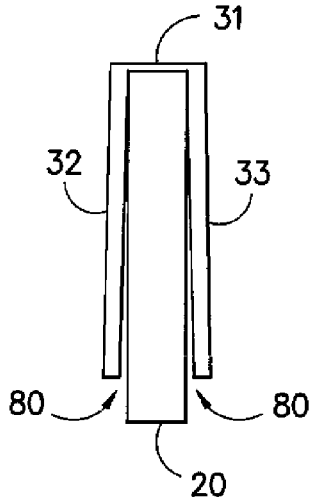
FIG. 4 provides a cross-sectional view of the gap formed between the side walls of an exemplary modular protective cover and a support frame.

The protective covers 30 may be formed from a variety of materials that are resistant to abrasion. For example, the protective cover 30 may be formed from a plastics material such as polyurethane or other high wear resistant polymer. Advantages of polyurethane include high resistance to abrasion, long wear life, and cost savings. The present disclosure, however, is not limited to a protective cover formed from a plastics material such as polyurethane. Using the teachings disclosed herein, one of ordinary skill in the art will recognize that other abrasion resistant materials may be used, such as rubber, polyethylene, polypropylene, or other materials resistant to wear. The protective cover 30 may also be configured to sacrificially wear in order to protect the support frame It is also desirable that the protective cover 30 be resiliently deformable. Referring to FIG. 4, a cross-sectional view of an exemplary embodiment of protective cover 30 mounted to a support frame 20 is shown. As illustrated, the protective cover 30 defines a gap 80 between the side walls 32, 33 and the support frame 20 when the protective cover 30 is mounted to the support frame 20. Abrasive materials tend to impact the support frame 20 at a slight angle from the vertical as the screened material falls through the apertures in the screening media. The gap 80 allows the modular protective cover 30 to cushion the severity of force imparted by the falling screened particles by springing in an elastic manner toward the support frame. The ability to spring away from the incidence of impact of the falling particle reduces the wear per collision of the falling particle. A protective cover 30 composed of a plastics material such as polyurethane or other polymer exhibits the desired resilient characteristics of the protective cover 30.

Figure 2:
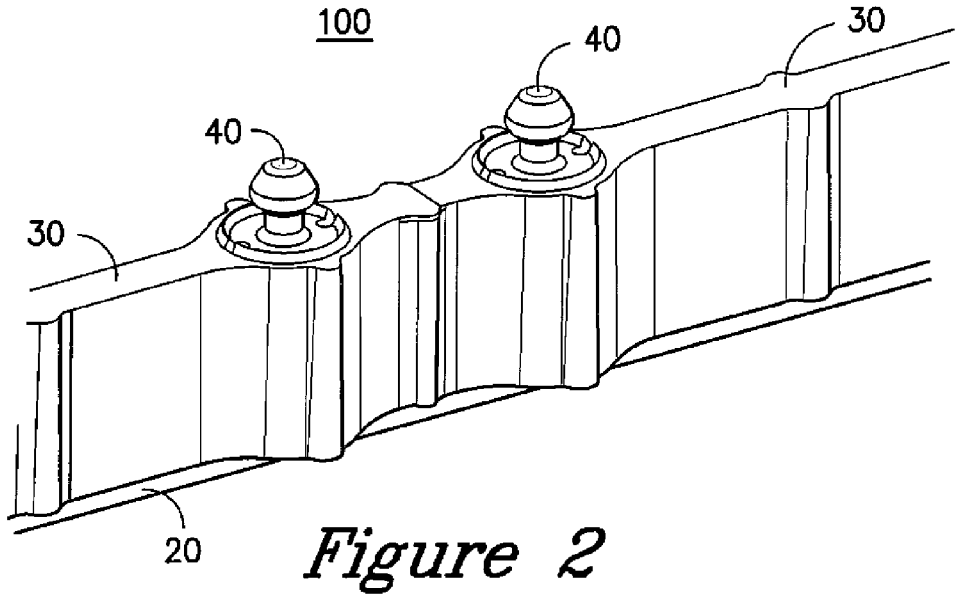
FIG. 2 provides a schematic illustration of another embodiment of the present invention mounted to an exemplary support frame.
Figure 3A:
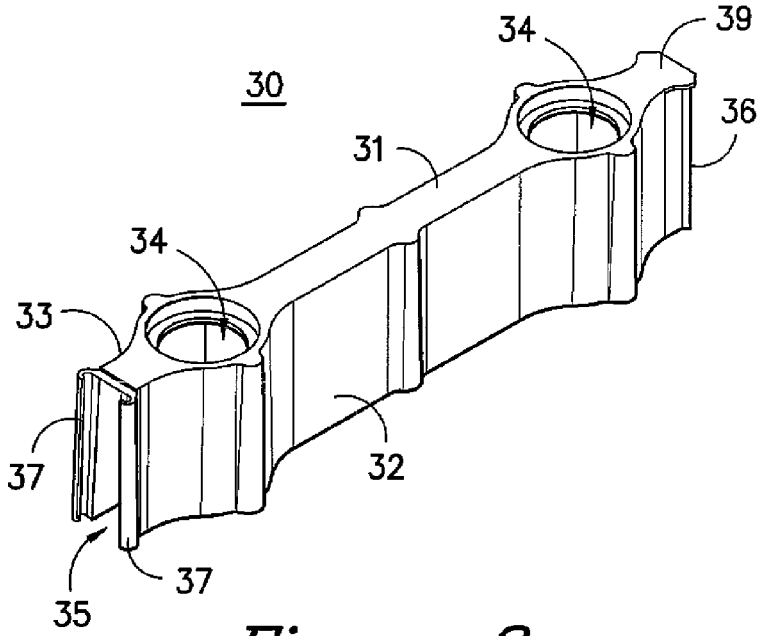
FIG. 3*a* provides a perspective view of a modular protective cover according to an exemplary embodiment of the present invention.
Figure 3B:
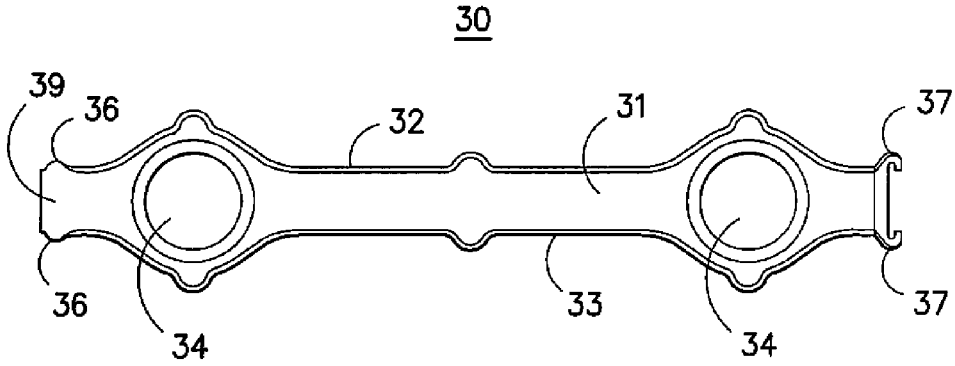
FIG. 3*b* provides a top view of a modular protective cover according to an exemplary embodiment of the present invention.

FIG. 2 depicts an exemplary embodiment of a modular system 100 for protecting a support frame 20 used in a screening arrangement according to the present invention. The modular system 100 includes a plurality of modular protective covers 30 mounted in side-by-side relationship. As shown in FIGS. 3*a* and 3*b*, each of the modular protective covers 30 includes a top surface 31 and two opposing side walls or surfaces 32, 33. The top surface 31 and two opposing side walls 32, 33 define a recess 35 configured to slide over the top of a support frame 20. Each modular protective cover 30 includes a male component 36 located at a first end of the modular protective cover 30 and a female component 37 located at a second and opposing end of the modular protective cover 30. In the particular embodiment depicted in FIGS. 3*a* and 3*b*, the protective cover 30 includes a male component 36 and a female component 37 on each side wall 32, 33 of the protective cover 30. As shown in FIGS. 2, and 5*a*-5*c*, the male component 36 of the modular protective cover 30 is adapted to mate with the female component 37 of an adjacent modular protective cover 30.

The protective cover 30 has two openings 34. These openings 34 are configured to overlap a socket 60 on a support frame 20 when the protective cover 30 is mounted to a support frame 20. The exemplary protective cover 30 depicted in FIGS. 2*a* and 2*b* has a shape adapted to slide over a portion of a support frame having two sockets 60 for receiving securing devices 40. The protective cover of the present invention is not limited to this particular embodiment and can have wide variety of shapes and configurations to accommodate any interval of sockets or fastening locations and any shape of support frame. For example, a protective cover may have a shape adapted to slide over a portion of a support frame with one socket, two sockets, three sockets, or even zero sockets. The modular system of the present invention may even include a plurality of modular protective covers each having a different shape or configuration adapted to slide over different portions of a support frame. The modular protective covers may have a variety of lengths such as 4 inches, 8 inches, 12 inches or other length.

Known protective covers for support frames fail to provide a seal at their interface locations. This allows both abrasive and chemical attacks of the protected structure at the interface between adjacent modular protective covers. The protective cover of the present disclosure overcomes this deficiency by providing a generally continuous protective cover along a length of a support frame. The interface between adjacent modular protective covers will now be discussed in detail As illustrated in FIGS. 3*a* and 3*b*, a protective cover 30 includes a male component 36 located at a first end of the protective cover 30 and a female component 37 located at a second end of the protective cover 30. The male component 36 depicted in FIGS. 3*a* and 3*b* has a cylindrical shape and the female component 37 consists of a complimentary groove for engagement with the cylindrical male component 36. However, the present disclosure is not limited to the particular shape and configuration of the male component 36 and the female component 37.

The protective cover 30 also includes a top seal cover 39. In the Figures, the top seal cover 39 is located above the male components 36 of the protective cover 30. However, the top seal cover 39 may also be located above the female components 37 of the protective cover 30. The top seal cover 39 provides enhanced protection for the interface between two adjacent protective covers 30. For example, the top seal cover 39 may prevent abrasive material and chemicals from attacking the interface between the mating male components 36 and female components 37 of the protective cover 30.

Figure 5A:
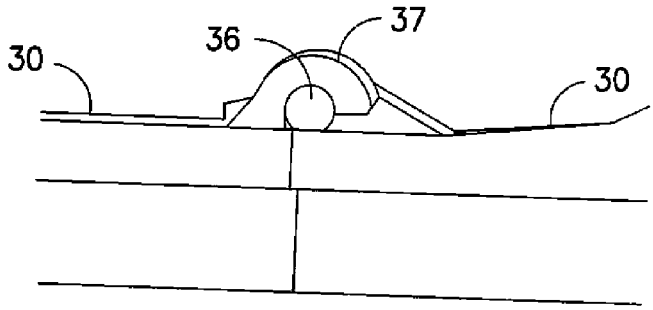
FIG. 5*a* provides a top view of the interface between modular protective covers according to an exemplary embodiment of the present invention.
Figure 5B:
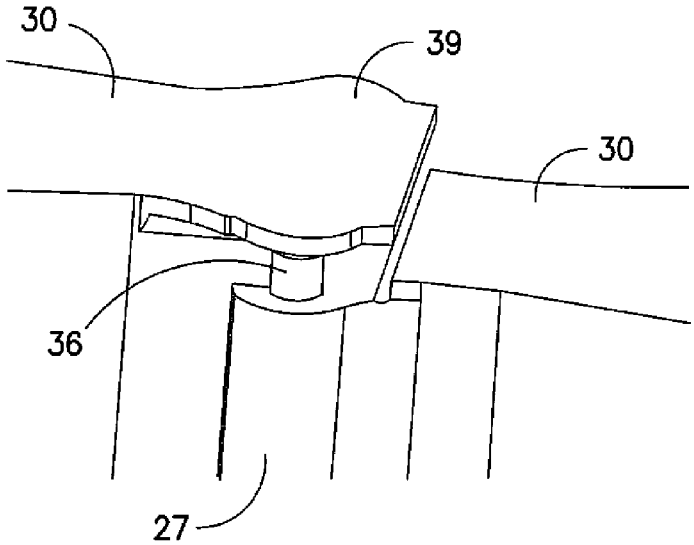
FIG. 5*b* provides a perspective view of the interface between modular protective covers according to an exemplary embodiment of the present invention.
Figure 5C:
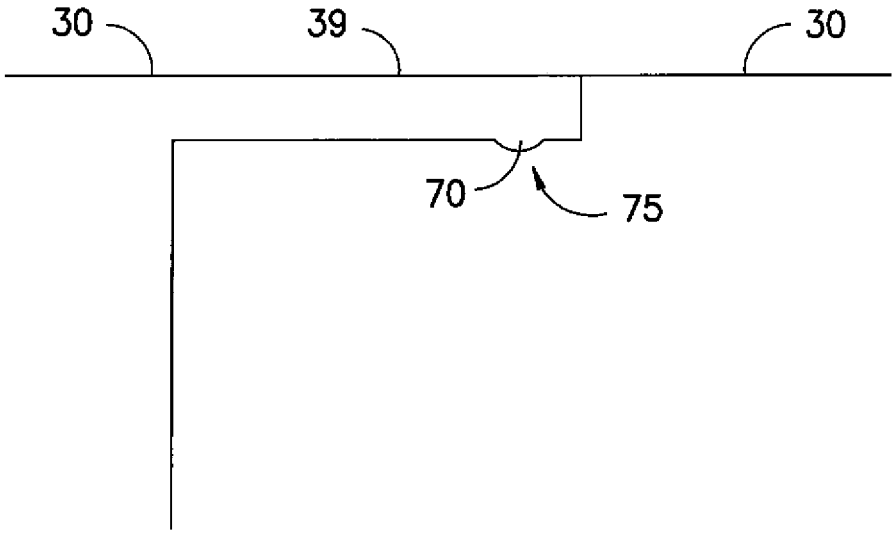
FIG. 5*c* provides a side view of the interface between modular protective covers according to an exemplary embodiment of the present invention.

Referring now to FIGS. 5*a*, 5*b*, and 5*c*, the interface between adjacent modular protective covers 30 will be discussed in detail. As shown in FIG. 5*a*, the male component 36 and the female component 37 employ an over-center snap which provides a mechanical connection for holding adjacent protective covers 30 together and provides a seal for the prevention of contaminants and wear particles from intruding into the space between the protective covers 30. FIG. 5*b* provides a perspective view of the male component 36 partially engaged with the female component 37. When the modular protective system is mounted to a support frame 20, the top seal cover 39 of the protective cover 30 aids in providing a generally continuous protective surface along a length of the support frame 20.

FIG. 5*c* depicts a side view of the interface between adjacent modular protective covers 30. The protective cover 30 shown in FIG. 5*c* has a convex surface 70 on the bottom surface of the top seal cover 39. The convex surface 70 is designed to mate with a concave surface 75 on the adjacent modular protective cover 30. These mating convex and concave surfaces form an additional seal at the interface between adjacent protective covers 30. With the over-center snap joint provided as shown in FIG. 5*a*, and the load (weight) of the screening media resting on top of the assembled components, the mating concave and convex surfaces are held together to form a seal at these interfaces.

The male and female components 36, 37, the top seal cover 39, and the mating convex and concave surfaces 70, 75 allow the modular protective members to interlock in multiple dimensions to provide a protective seal at the interface between adjacent protective covers 30. The protective seal at the interface between adjacent modular protective covers 30 provides a generally continuous protective cover over a length of the support frame 20 as shown in FIGS. 1 and 2. The generally continuous protective cover prevents abrasive materials and chemicals from attacking the support frame 20 at the interface of two modular protective covers 30.

Figure 6:
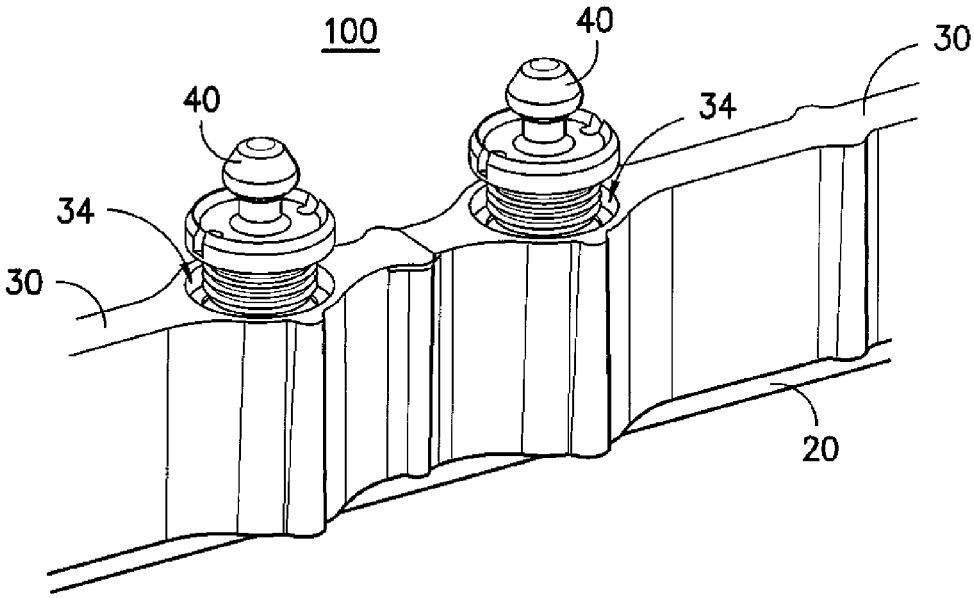
FIG. 6 provides an exploded view of a modular protective cover according to an exemplary embodiment of the present invention and an exemplary securing device used to secure the screening media to the support frame.

In addition to the above features, the protective system of the present disclosure also provides enhanced protection for the sockets 60 of the support frame 20. FIG. 6 depicts a protective system 100 with two adjacent protective covers 30 mounted to a support frame 20 in side-by-side relationship. Exemplary securing devices 40 are used to fasten screening media 50 to the support frame 20. The modular protective cover 30 is secured to the support frame 20 by inserting the securing device 40 into the opening 34 of the modular protective cover 30. The securing device 40 is then inserted into the socket 60 of the support frame 20. In the embodiment shown in FIG. 6, the securing device is fastened to the support frame 20 by a screw thread. However, the present invention is not limited to this disclosure. The securing device 40 may also be secured to the support frame 20 by a snap fit or other connection known in the art.

Figure 7:
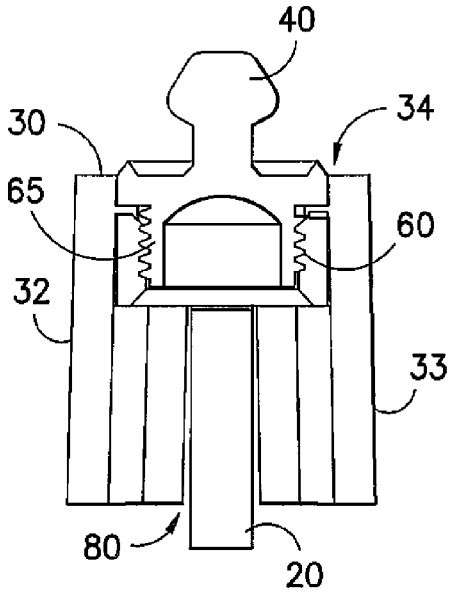
FIG. 7 provides a sectional view illustrating the interface between a modular protective cover according to an exemplary embodiment of the present invention and an exemplary securing device used to secure the screening media to the support frame.

As shown in FIG. 7, the protective cover 30 is contained in a compressed manner between the securing device 40 and the socket 60 at region 65 for containment of the securing element of the protective cover 30. This arrangement prevents the incursion of screened materials and chemicals into the socket 60. Thus, not only does the protective system provide a generally continuous protective cover along a length of the support frame, but also provides protection for features such as sockets located in the support frame.

The components of the protective system 100 may be easily manufactured using injection molding or similar processes. Initial installation of the system onto a support frame requires no special tools and may be performed as part of the required installation of modular screening media. Removal and replacement of the individual components of the modular protective system may be performed at the same time the worn screening media is removed and replaced.

The individual modular protective covers of the modular system may be manufactured in a variety of configurations to provide the proper protective cover for the area of the support frame on which the protective cover or modular protective cover is mounted. These different configurations may interlock in the same manner to provide a continuous seal and protective cover over the length of the support on which the modular system is used, regardless of the variety of configurations of individual protective covers used.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A modular system for protecting a support frame used in a screening arrangement, the modular system comprising:

a plurality of modular protective covers mounted in side-by-side relationship, each of the modular protective covers comprising:

a top surface and two opposing side walls, the top surface and two opposing side walls defining a recess, said recess sliding over the support frame such that the support frame is disposed between said two opposing side walls;

a male component located at a first end of the modular protective cover;

a female component located at a second end of the modular protective cover; and a top seal cover having a convex surface that mates with a concave surface located on an adjacent modular protective cover;

wherein the male component of each modular protective cover engages the female component of an adjacent modular protective cover.

2. The modular system of claim 1, wherein each modular protective cover comprises a male component and a female component located on each of the two opposing side walls.

3. The modular system of claim 1, wherein at least one of the side walls of a modular protective cover springs in an elastic manner when imparted by falling materials.

4. The modular system of claim 1, wherein at least one modular protective cover further comprises an opening configured to receive a securing device.

5. The modular system of claim 1, wherein the modular protective covers are formed from an abrasion resistant material.

6. A screening arrangement for use in screening materials, the screening arrangement comprising:

a support frame comprising a socket; and a plurality of protective covers mounted in side-by-side relationship along a length of the support frame, each of the modular protective covers comprising:

a top surface and two opposing side walls, the top surface and two opposing side walls defining a recess engaging a portion of the support frame such that the support frame is disposed between said two opposing side walls;

a male component located at a first end of the modular protective cover; and a female component located at a second end of the modular protective cover;

wherein the male component of each modular protective cover engages the female component of an adjacent modular protective cover so as to provide a generally continuous surface along a length of the support frame and wherein at least one of the modular protective covers comprises an opening that overlaps the socket when the modular protective cover is mounted to the support frame.

7. The screening arrangement of claim 6, wherein the screening arrangement further comprises a securing device for securing screening media to the support frame.

8. The screening arrangement of claim 7, wherein at least one modular protective cover is mounted to the support frame by inserting the securing element through the opening of the modular protective cover and into the socket of the support frame.

9. The screening arrangement of claim 8, wherein the securing device comprises a sleeve for receiving a protrusion formed on the screening media.

10. The screening arrangement of claim 8, wherein the securing element comprises a protrusion that engages an indentation formed on the screening media.

11. The screening arrangement of claim 6, wherein at least one of the side walls of the modular protective cover forms a gap between the support frame and the side wall when the modular protective cover is mounted to the support frame such that the side wall springs in an elastic manner toward the support frame when imparted by falling materials.

* * * * *